US007932676B2

(12) United States Patent
Nishitani et al.

(10) Patent No.: US 7,932,676 B2
(45) Date of Patent: Apr. 26, 2011

(54) PLASMA DISPLAY PANEL

(75) Inventors: Mikihiko Nishitani, Nara (JP); Masahiro Sakai, Kyoto (JP); Yusuke Fukui, Osaka (JP); Yosuke Honda, Osaka (JP); Yasuhiro Yamauchi, Osaka (JP); Michiko Okafuji, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/680,053

(22) PCT Filed: Jul. 16, 2009

(86) PCT No.: PCT/JP2009/003368

§ 371 (c)(1),
(2), (4) Date: Mar. 25, 2010

(87) PCT Pub. No.: WO2010/010677

PCT Pub. Date: Jan. 28, 2010

(65) Prior Publication Data

US 2010/0207524 A1 Aug. 19, 2010

(30) Foreign Application Priority Data

Jul. 25, 2008 (JP) ..... 2008-192679

(51) Int. Cl.
*H01J 17/49* (2006.01)

(52) U.S. Cl. ..... 313/587; 313/586

(58) Field of Classification Search ..... 313/582–587
See application file for complete search history.

(56) References Cited

U.S. PATENT DOCUMENTS

| | | | | |
|---|---|---|---|---|
| 2004/0075388 | A1* | 4/2004 | Miyashita et al. | 313/586 |
| 2006/0103307 | A1* | 5/2006 | Yan et al. | 313/582 |
| 2007/0262715 | A1* | 11/2007 | Yan et al. | 313/582 |

FOREIGN PATENT DOCUMENTS

| | | | |
|---|---|---|---|
| JP | 2000-173476 | A | 6/2000 |
| JP | 2003-100217 | A | 4/2003 |
| JP | 2003-346663 | A | 12/2003 |
| JP | 2006-196476 | A | 7/2006 |
| JP | 2008-152947 | A | 7/2008 |

* cited by examiner

*Primary Examiner* — Bumsuk Won
(74) *Attorney, Agent, or Firm* — Hamre, Schumann, Mueller & Larson, P.C.

(57) ABSTRACT

The present invention provides a plasma display panel (PDP) with a protective film improved so as to achieve a lower discharge starting voltage. A surface portion of the protective film 16 substantially is composed of magnesium (Mg), aluminum (Al), nitrogen (N), and oxygen (O). The protective film 16 is formed so that in the surface portion of the protective film 16, a ratio of the number of atoms of the aluminum to a total of the number of atoms of the magnesium and the number of atoms of the aluminum is at least 2.1% but not more than 66.5%, a ratio of the number of atoms of the nitrogen to a total of the number of atoms of the nitrogen and the number of atoms of the oxygen is at least 1.2% but not more than 17.2%, and a ratio of the total of the number of atoms of the nitrogen and the number of atoms of the oxygen to the total of the number of atoms of the magnesium and the number of atoms of the aluminum is at least 1.0 but not more than 1.35.

4 Claims, 5 Drawing Sheets

PLASMA DISPLAY PANEL

TECHNICAL FIELD

The present invention relates to a plasma display panel (hereinafter referred to as a "PDP"). More specifically, the present invention relates to a PDP characterized by a protective film covering a dielectric layer formed on a front substrate.

BACKGROUND ART

Plasma display panels are classified into direct current (DC) type and alternating current (AC) type. The AC type PDPs are superior to the DC type PDPs in terms of luminance, light emitting efficiency, and length of life, and widely have been used.

In the AC type PDPs, an electrode and a dielectric layer are formed in this order on a front substrate, and a protective film further is formed to cover the dielectric layer. Magnesium oxide (MgO) is used as the material for the protective film. This is because magnesium oxide has been considered to be superior to other materials in terms of functions required for the protective film, that is, sputtering resistance and electron emission characteristics. It is possible to lower a discharge starting voltage of a PDP by using a material, such as magnesium oxide, having a large secondary electron emission coefficient (γ) for the protective film facing discharge spaces in the PDP.

JP 2000-173476 A (Patent Literature 1) proposes that a surface layer of a protective film be composed of a magnesium oxide in which oxygen is partly substituted by nitrogen. According to the Patent Literature 1, a PDP with a protective film having a surface layer with a composition represented by $Mg_3O_{3(1-x)}N_{2x}$, where $0<x<7$, has a lower discharge starting voltage than that of a PDP with a protective film composed of magnesium oxide.

JP 2003-100217 A (Patent Literature 2) proposes that a protective film have a composition represented by AlNX, where X is at least one selected from Si, Ge, Sn, Pb, Be, Mg, Ca, O, and S. According to the Patent Literature 2, AlN has an excellent sputtering resistance and electron emission characteristics, and adding an element other than Al and N thereto further enhances these properties (paragraphs 0022 and 0023). The Patent Literature 2 discloses, in Example 4 thereof, $(Al_{1-a-b}M_aD_b)_{1-d}(N_{1-c}A_c)_d$, where M is at least one selected from Si, Ge, Sn, and Pb, D is at least one selected from Be, Mg, and Ca, A is at least one selected from O and S, and $0.3<d<0.5$; "δ" in the Patent Literature 2 is rewritten as "d" here; and referring to claim 2, $0\leqq a\leqq 0.5$, $0\leqq b\leqq 0.5$, $0\leqq a+b\leqq 0.5$, $0\leqq c\leqq 0.5$, and $0<a+b+c\leqq 1$, although this is not clearly stated in the Example 4. In Table 4 showing the results of the Example 4, $(AlMg)_{0.60}(NO)_{0.40}$ is listed as an example.

As mentioned above, there conventionally have been proposed protective films in which the ratio of the number of nonmetal atoms, such as N and O, to the number of metal atoms, such as Mg and Al, is less than 1 (for example, the ratio is 2/3 in the above-mentioned $(AlMg)_{0.60}(NO)_{0.40}$). This seems to be related to the well-known fact that the secondary electron emission coefficient is increased when magnesium oxide is made oxygen-deficient, as disclosed in paragraph 0005 of the Patent Literature 1.

CITATION LIST

Patent Literature

[PTL 1] JP 2000-173476 A

[PTL 2] JP 2003-100217 A

SUMMARY OF INVENTION

Technical Problem

Currently, a neon (Ne)-xenon (Xe) inert gas is sealed in discharge spaces of AC type PDPs in practical use. The partial pressure of xenon in the inert gas is 5% to 10%. The discharge starting voltage depends mainly on a secondary electron emission caused by Auger neutralization that occurs when Ne ions or Xe ions approach enough close to the protective film so as to interact with the protective film in the discharge space. In the secondary electron emission using an Ne—Xe inert gas, Ne ions serve a major role and the contribution by Xe ions is quite small.

Like other displays, the PDPs also are required to have a further improved image quality, which requires the PDPs to have higher definition. In order to achieve the higher definition, the panels need to have high luminance and high efficiency. In order to allow the PDPs to have high luminance and efficiency, it is desirable to increase the partial pressure of xenon sealed in the discharge spaces. This is because a larger amount of ultraviolet rays are emitted from xenon than from neon when the excited state is relaxed to the ground state. However, when the partial pressure of xenon is increased, the amount of the Ne ions contributing significantly to the secondary electron emission is decreased, resulting in a higher discharge starting voltage. The higher discharge starting voltage makes it necessary for a drive circuit of the PDP to use high voltage transistors that allow for a high discharge starting voltage. Using such transistors increases the production cost of the PDP.

The protective films disclosed in the Patent Literatures 1 and 2 may be desirable because they lower the discharge starting voltage of the PDP to some extent. However, considering a PDP with an increased partial pressure of xenon in the inert gas filling the discharge spaces, it is necessary to improve further the protective film so as to achieve an even lower discharge starting voltage.

In view of the foregoing, the present invention intends to provide a PDP with a protective film that has been improved so as to achieve the even lower discharge starting voltage.

Solution to Problem

The PDP of the present invention includes: a front substrate; a rear substrate disposed facing the front substrate; and barrier ribs dividing a space between the front substrate and the rear substrate into discharge spaces. A protective film is formed in such a manner that the protective film covers a dielectric layer formed on the front substrate and is exposed to the discharge spaces. A surface portion of the protective film substantially is composed of magnesium, aluminum, nitrogen, and oxygen. A ratio of the number of atoms of the aluminum to a total of the number of atoms of the magnesium and the number of atoms of the aluminum is at least 2.1% but not more than 66.5%. A ratio of the number of atoms of the nitrogen to a total of the number of atoms of the nitrogen and the number of atoms of the oxygen is at least 1.2% but not more than 17.2%. A ratio of the total of the number of atoms of the nitrogen and the number of atoms of the oxygen to the total of the number of atoms of the magnesium and the number of atoms of the aluminum is at least 1.0 but not more than 1.35.

Advantageous Effects of Invention

In the PDP of the present invention, the composition of the protective film is adjusted so as to achieve a lower discharge starting voltage. One of the characteristics of the protective film resides in the fact that the large/small relationship of the number of nonmetal atoms to the number of metal atoms (Mg and Al) is opposite to that in conventionally proposed films containing Mg and 0. More specifically, the ratio of the former to the latter is adjusted to be at least 1.0. The present invention makes it possible to drive a PDP, such as a PDP in which an Ne—Xe inert gas is sealed with a xenon partial pressure more than 10%, that previously needed to be driven at a higher voltage than a conventionally-used voltage, at a voltage comparable to the conventionally-used voltage.

DESCRIPTION OF EMBODIMENT

Figure 1:
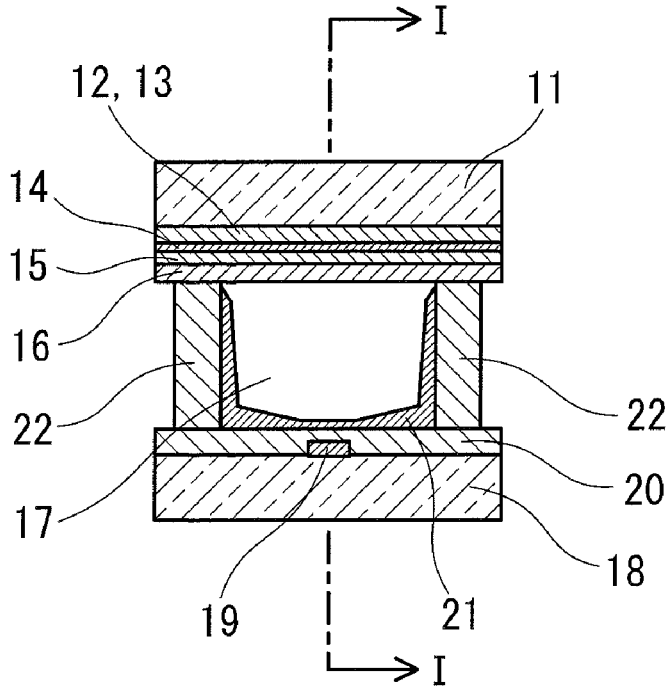
FIG. 1 is a cross-sectional view showing an embodiment of the PDP of the present invention.
Figure 2:
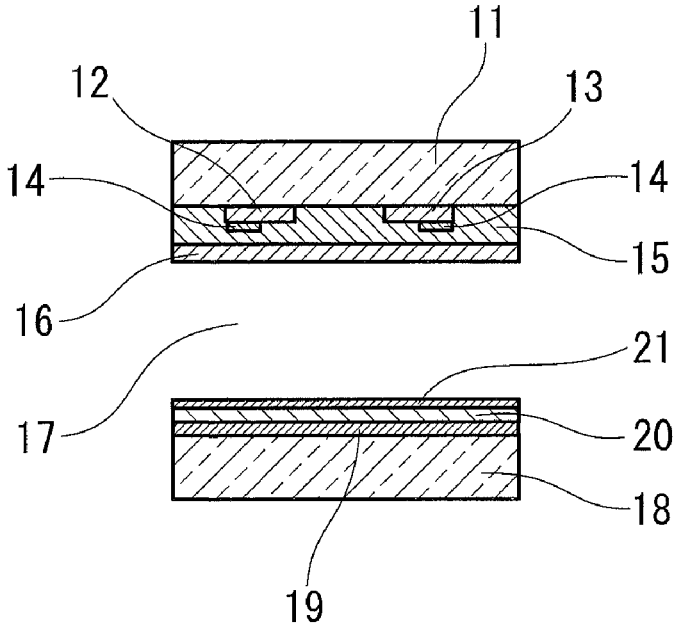
FIG. 2 is a cross-sectional view taken along the line I-I of FIG. 1.

The PDP of the present invention can be composed of conventionally-used components except for the protective film. The structure of the PDP is not particularly limited as long as it allows the protective film of the present invention to exhibit the effect of lowering the discharge starting voltage. Based on this, an embodiment of the PDP of the present invention will be described hereinafter with reference to the drawings. FIG. 1 is a cross-sectional view showing the embodiment of the PDP of the present invention. FIG. 2 is a cross-sectional view taken along the line I-I of FIG. 1. The PDP shown in FIGS. 1 and 2 is a so-called AC type PDP.

Transparent electrodes (for which indium tin oxide (ITO) or tin oxide ($SnO_2$) usually is used) 12 and 13 are formed on a front substrate 11 composed of a transparent insulating substrate (for which a glass sheet usually is used). The transparent electrode 12 is a scanning electrode, and the transparent electrode 13 is a sustaining electrode 13. The electrodes 12 and 13 are adjacent to each other and extend parallel to each other so as to pass above the same discharge cell, a discharge cell 17. A voltage is applied between the transparent electrodes 12 and 13 so as to generate a sustain discharge (display discharge) in the discharge cell 17 that has been selected beforehand by an address electrode 19 to be described later and holds wall charge accumulated therein. Since transparent conductive materials composing the transparent electrodes 12 and 13 have an insufficiently low sheet resistance, it is not possible to supply a sufficient amount of electric power to all pixels when the panel is of a large size. In order to complement this, a bus electrode 14 is formed on each of the transparent electrodes 12 and 13. The bus electrode 14 is an auxiliary low resistance electrode composed of a film such as a thick silver film, a thin aluminum film, and a laminated thin film of chromium-copper-chromium (Cr—Cu—Cr).

A transparent dielectric layer 15 (for which a low-melting glass usually is used) is formed on the electrodes 12, 13, and 14, and a protective film 16 further is formed so as to cover the dielectric layer 15. The dielectric layer 15 has a current limiting function peculiar to the AC type PDPs and contributes to their relatively long lives. Conventionally, the protective film 16 is composed of magnesium oxide. The material for the protective film 16 used in the present embodiment will be described later.

A rear substrate 18 composed of a transparent insulating substrate is disposed in parallel with the front substrate 11, keeping a predetermined distance from the front substrate 11. The address electrode 19 for writing for image data and a base dielectric layer 20 are formed in this order on the rear substrate 18. Barrier ribs 22 are formed on the base dielectric layer 20. The barrier ribs 22 divide a discharge space present between the front substrate 11 and the rear substrate 18 into the discharge cells 17. The address electrode 19 and the barrier ribs 22 extend in a direction perpendicular to a direction in which the transparent electrodes 12 and 13 extend. A phosphor layer 21 adheres to the base dielectric layer 20 and the barrier ribs 22 and is exposed to a space in the discharge cell 17. The phosphor layer 21 is composed of one of R, G, B (red, green, and blue) phosphors.

When a discharge occurs in the discharge cell 17, ultraviolet rays with a wavelength corresponding to the type of the sealed-in inert gas are emitted in the cell 17. A visible light having a wavelength determined according to the phosphor material composing the phosphor layer 21 is emitted. The barrier ribs 22 serving to separate the discharge cells 17 also serves to prevent discharge errors and optical cross talk.

The discharge cell 17 usually is filled with an inert gas (a discharge gas) composed of neon (Ne) and xenon (Xe). Usually, the pressure of the discharge gas is 23.9 KPa (180 Torr) to 79.8 KPa (600 Torr), and it is approximately 66.7 kPa (500 Torr), for example. As mentioned above, in practically-used PDPs, the partial pressure of xenon in the discharge gas composed of neon and xenon currently is 5% to 10%. Although the present invention is also applicable to PDPs using a discharge gas with a partial pressure of Xe in a range comparable to the above-mentioned range, the present invention is effective especially when applied to PDPs in which the partial pressure of Xe in the discharge gas is set high to achieve a higher luminance. More specifically, the present invention significantly is effective when applied to PDPs using a discharge gas that is a mixed gas of neon and xenon, in which the partial pressure of xenon in the discharge gas is set in the range of 11% to 100% of a total pressure of the discharge gas, in some cases 40% to 100%, and further 70% to 100%.

The PDP of the present invention is applicable not only to PDPs using an Ne—Xe discharge gas but also to PDPs using another gas such as a discharge gas containing helium (He), argon (Ar), and krypton (Kr).

A surface portion of the protective film 16 substantially is composed of magnesium (Mg), aluminum (Al), nitrogen (N), and oxygen (O). In this description, the term "substantially" is meant to allow the protective film to contain impurities difficult to remove completely in the mass production process to such an extent that hardly affects the properties of the protective film. Specifically, the term means that atoms of another element may be contained in an amount less than 0.1 atom %.

The ratios of Mg, Al, N, and O are determined in the following ranges. The ratio of the number of Al atoms to a total of the numbers of Mg atoms and Al atoms, represented by (Al/(Mg+Al)×100 [%]), is at least 2.1% but not more than 66.5%. The ratio of the number of N atoms to a total of the numbers of N atoms and O atoms, represented by (N/(N+O)×100 [%]), is at least 1.2% but not more than 17.2%. The ratio of the total of the numbers of N atoms and O atoms to the total of the numbers of Mg atoms and Al atoms, represented by ((N+O)/(Mg+Al)), is at least 1.0 but not more than 1.35.

In the secondary electron emission, the discharge starting voltage is affected significantly by the surface portion of the protective film 16. Therefore, the composition of the surface portion of the surface of the protective film is limited in the present invention. From the viewpoint of ensuring that the composition of the surface portion is in the desired range, it is desirable that the other portion of the protective film also have a composition in the range limited for the surface portion. However, the composition may be out of this range. Specifically, the composition of the surface portion can be measured by an XPS (X-ray photoelectron spectroscopy) method. The XPS method makes it possible to analyze the composition of an outermost surface of a film, specifically the composition of a film from its surface to a depth of several nanometers. In this description, the term "a surface portion" refers to a portion that can be analyzed by the XPS method adopted for measuring a film surface.

The thickness of the protective film 16 is not particularly limited, and may be a thickness comparable to a thickness that is used conventionally. For example, it may be in the range of 0.5 μm to 1 μm.

EXAMPLE

Hereinafter, the present invention will be described in further detail using examples, but is not limited by the following examples.

First, the method for evaluating the discharge characteristics of the protective films used in the following example is described. The discharge characteristics were measured using a pair of electrodes disposed facing each other in a sealed chamber. The distance between the electrodes was 10 cm. Argon (Ar) gas was used as the discharge gas in the chamber. One of the electrodes was grounded, and the other was connected to a high frequency power supply (13.56 MHz). A protective film to be evaluated was formed on the electrode (the high frequency electrode) connected to the high frequency power supply. Then, the pressure of the discharge gas gradually was increased from 0.5 Pa while keeping the discharge power applied between the pair of electrodes constant (8 W). The pressure at which the discharge began was measured.

In a high frequency discharge under a pressure that allows electrons to go back and forth between electrodes, the discharge starting voltage depends basically on ions and electrons generated in the discharge space. However, the ions and electrons of the discharge gas hardly are generated when the pressure in the discharge space decreases. In such a situation, the ions and electrons generated on a surface of the high frequency electrode determine the discharge starting voltage. This makes it possible to evaluate the secondary electron emission coefficient of the protective film by a method such as the above-mentioned method.

Figure 3:
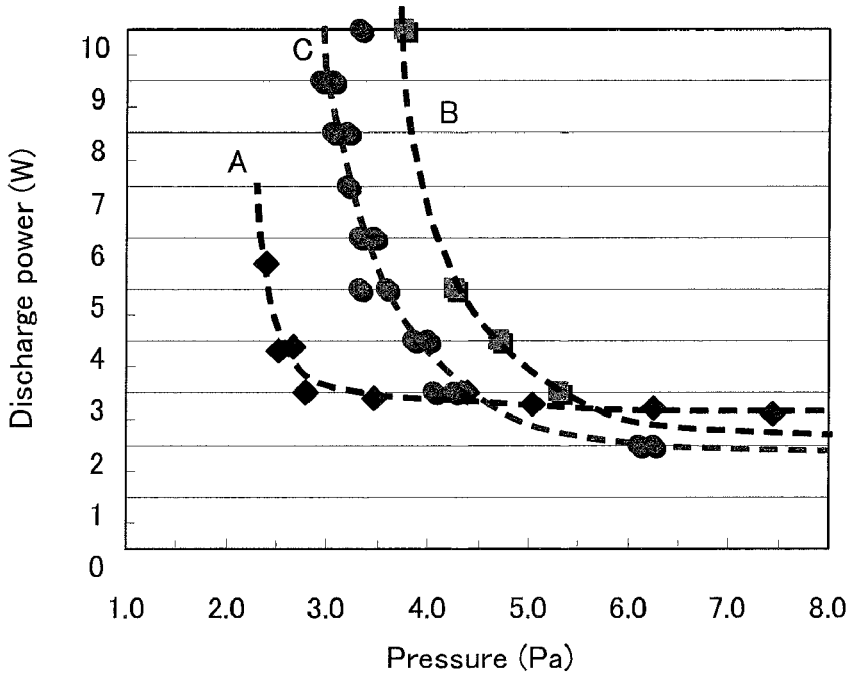
FIG. 3 is a graph showing a relationship between a discharge starting pressure and a discharge power in each of three kinds of protective films.

In order to verify the appropriateness of the evaluation method, a verification experiment using three kinds of protective films was conducted. FIG. 3 shows the results of the evaluation made on protective films A, B, and C using the above-mentioned method. These films were formed of different materials from each other. In this verification experiment, the discharge power suitably was selected in the range shown on the vertical axis of the graph, and the discharge starting pressure was measured at this discharge power. As a result, the protective film A had the lowest discharge starting pressure, followed by the protective film C and B in this order, as shown in FIG. 3.

Figure 4:
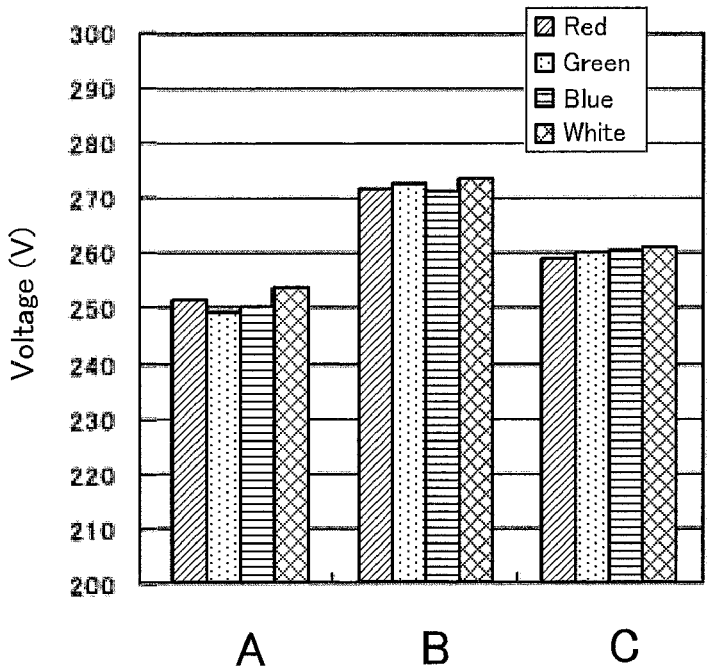
FIG. 4 is a graph showing self-sustaining discharge voltages of PDPs using the three kinds of protective films shown in FIG. 3.

FIG. 4 shows self-sustaining discharge voltages of test PDPs (with a discharge gas composed of Xe gas 100%) produced using the protective films A, B, and C. The self-sustaining discharge voltage was measured for each type of the phosphors (R,G, and B), with the three types of phosphors emitting light at the same time (white light emission). In the test PDPs, the self-sustaining discharge voltages reflected the above-mentioned discharge starting pressures well, and the protective film with a lower discharge starting pressure had a lower self-sustaining discharge voltage. Hence, the above-mentioned evaluation method was proved to be appropriate as the method for evaluating the secondary electron emission coefficient of the protective film, which is an issue for actual PDPs.

Each of the protective films was formed on the high frequency electrode by a sputtering method or an electron beam evaporation (EB) method. The thickness thereof was 0.5 μm. Table 1 shows the sputtering targets used in the sputtering method and the evaporation sources used in the EB method, as well as the film forming atmosphere.

Table 1 also shows the compositions of the protective films measured by the XPS method. Soft X rays used in the XPS method were Alkα (1.485 keV). An automatic etching operation, which occasionally is performed for analyzing a composition change in a depth direction of a film, was not performed in these measurements. Only the surface portion of the film was evaluated for composition. Moreover, the results shown in Table 1 were obtained when the X rays were incident on the samples perpendicularly and the electrons emitted in a direction inclined 45° from the perpendicular direction were observed spectrally.

TABLE 1

| Sample No. | Film composition (atom %) Mg | Al | O | N | Target/ evaporation source | Film forming atmosphere | Al/(Mg + Al) (Al ratio, %) | N/(N + O) (N ratio, %) | Al ratio/ N ratio | (N + O)/ (Mg + Al) | Discharge starting pressure (Pa) | Example/ Comparative Example |
|---|---|---|---|---|---|---|---|---|---|---|---|---|
| 0 | 40.2 | 0.0 | 57.8 | 2.0 | MgO | $N_2$ | 0.0 | 3.3 | 0 | 1.49 | 1.60 | C. Example |
| 1 | 39.8 | 1.1 | 58.0 | 1.2 | MgO/Al | $N_2$ | 2.7 | 2.0 | 1.4 | 1.45 | 0.73 | C. Example |
| 2 | 41.6 | 0.9 | 55.8 | 1.7 | MgO/Al | $N_2$ | 2.1 | 3.0 | 0.7 | 1.35 | 0.20 | Example |
| 3 | 41.7 | 3.3 | 50.3 | 4.8 | MgO/Al | $N_2$ | 7.3 | 8.7 | 0.8 | 1.22 | 0.29 | Example |
| 4 | 26.4 | 19.2 | 45.1 | 9.4 | MgO/Al | $N_2$ | 42.1 | 17.2 | 2.4 | 1.20 | 0.40 | Example |
| 5 | 0.0 | 46.1 | 41.2 | 12.8 | AlN | $N_2$ | 100.0 | 23.7 | 4.2 | 1.17 | 2.00 | C. Example |
| 6 | 0.0 | 43.6 | 50.8 | 5.7 | AlN | $N_2$ | 100.0 | 10.1 | 9.9 | 1.30 | 0.98 | C. Example |
| 7 | 5.1 | 40.2 | 48.9 | 5.8 | AlN/MgO | $N_2$ | 88.7 | 10.6 | 8.4 | 1.21 | 0.88 | C. Example |
| 8 | 9.6 | 37.5 | 44.6 | 8.3 | AlN/MgO | $N_2$ | 79.6 | 15.7 | 5.1 | 1.12 | 0.81 | C. Example |
| 9 | 29.9 | 20.1 | 46.6 | 3.4 | AlN/MgO | $N_2$ | 40.2 | 6.8 | 5.9 | 1.00 | 0.21 | Example |
| 10 | 16.5 | 32.7 | 42.6 | 8.2 | AlN/MgO | $N_2$ | 66.5 | 16.1 | 4.1 | 1.03 | 0.43 | Example |
| 11 | 1.70 | 41.7 | 48.1 | 8.5 | AlN/MgO | $N_2$ | 96.1 | 15.0 | 6.4 | 1.30 | 0.84 | C. Example |
| 12 | 15.6 | 27.3 | 56.5 | 0.7 | AlN/MgO | $N_2$ | 63.6 | 1.2 | 53.0 | 1.33 | 0.29 | Example |
| 13 | 4.1 | 40.7 | 42.0 | 13.3 | AlN/MgO | $N_2$ | 90.8 | 24.1 | 3.8 | 1.23 | 1.21 | C. Example |
| 14 | 21.0 | 25.7 | 40.6 | 12.7 | AlN/MgO | $N_2$ | 55.0 | 23.8 | 2.3 | 1.14 | 0.80 | C. Example |
| 15 | 0.0 | 64.6 | 34.6 | 0.7 | AlN | — | 100.0 | 2.0 | 50.0 | 0.55 | 0.67 | C. Example |
| 16 | 0.0 | 63.6 | 35.7 | 0.7 | AlN | — | 100.0 | 1.9 | 52.6 | 0.57 | 0.84 | C. Example |
| 17 | 0.0 | 59.8 | 40.2 | 0.0 | AlN | — | 100.0 | 0.0 | — | 0.67 | 0.84 | C. Example |
| 18 | 31.7 | 20.0 | 47.8 | 0.5 | AlN + MgO | — | 38.7 | 1.0 | 38.7 | 0.93 | 0.54 | C. Example |

A sputtering method was used for Samples 0 to 14, and an EB method was used for Samples 15 to 18.

In Table 1, MgO/Al indicates that an Al foil is disposed on a part of a surface of an MgO sputtering target. AlN/MgO indicates an MgO crystalline sputtering target is disposed on a part of a surface of an AlN sputtering target. By using these sputtering targets and adjusting the ratio of the area of the Al foil, etc. to be disposed, it is possible to control the ratio of atoms to be sputtered. In the sputtering method, the film was formed while nitrogen gas was being supplied into the chamber. The notation AlN+MgO (Sample 18) indicates that the film was formed by coevaporation using two evaporation sources, which are an AlN evaporation source and an MgO evaporation source.

The discharge starting pressure of the MgON protective film (Sample 0) free from Al was 1.60 Pa, which is not sufficiently low. Al was effective in lowering the discharge starting pressure even when present in a trace amount (Sample 2). However, an excessively high ratio of Al to the total of Mg and Al failed to lower the discharge starting pressure sufficiently (Samples 5 to 8). Likewise, N lowered the discharge starting pressure significantly even when contained in a trace amount (Sample 12). However, an excessively high ratio of N to the total of N and O failed to lower the discharge starting pressure sufficiently (Sample 14). Moreover, the discharge starting pressure was not lowered sufficiently in both cases where the ratio of nonmetal atoms (O and N) to metal atoms (Mg and Al) was excessively low (Sample 18) and excessively high (Sample 1).

Conventionally, it is known that the secondary electron emission coefficient is increased when magnesium oxide intentionally is made oxygen-deficient (as disclosed in JP 2000-173476 A (Patent Literature 1), paragraph 0005, for example). In the protective films disclosed in JP 2000-173476 A (Patent Literature 1) and JP 2003-100217 A (Patent Literature 2), the ratio of the total of the number of nonmetal atoms, such as O and N, to the total of the number of metal atoms, such as Al and Mg, also is set to be less than 1. Contrary to this, however, a protective film in which the ratio of (N+O)/(Mg+Al) in terms of the number of atoms is in the range of 1.0 to 1.35 both inclusive was proved to be appropriate in order to achieve a lower discharge starting voltage, in other words, a lower discharge starting pressure based on a higher secondary electron emission coefficient, at least when [Al/(Mg+Al)] falls in the range of 2.1% to 66.5% and [N/(N+O)] falls in the range of 1.2% to 17.2%.

Some of the samples produced above were measured for electronic emission spectrum from a valence band observed by the XPS (hereinafter referred to as an "X-ray electronic emission spectrum") and for electronic emission spectrum generated by photon radiation (hereinafter referred to as a "UV electronic emission spectrum"). The UV electronic emission spectrum was obtained by measuring electrons emitted when the sample was irradiated with visible/ultraviolet rays with a wavelength of 500 nm to 200 nm. The X-ray electronic emission spectrum is considered to reflect the state of the surface portion of the film. In contrast, the UV electronic emission spectrum is considered to reflect the state of a portion deeper than the portion reflected by the X-ray electronic emission spectrum. FIG. 5 to FIG. 13 show these spectra. In FIG. 5 to FIG. 13, the X-ray electronic emission spectrum is indicated by a solid line and the UV electronic emission spectrum is indicated by a dashed line, respectively.

Regarding the X-ray electronic emission spectrum, a region where a binding energy is 6 eV or less is hatched lightly in FIGS. 5 to 13. Compared to the results shown in Table 1, the figures reveal that a sample with a larger hatched region tends to have a lower discharge starting pressure.

In FIGS. 5 to 7 and FIG. 10 showing the results of Samples 2 to 4 and Sample 9, respectively, the X-ray electronic emission spectrum has the highest value around a binding energy of 5 eV. Considering the fact that these samples each had a particularly low discharge starting pressure, it is desirable that the highest value in the X-ray electronic emission spectrum emitted from the protective film be in a low energy region of 6 eV or less.

Among the samples, Samples 2 to 4 (FIGS. 5 to 7) exhibited the X-ray electronic emission spectrum with a similar shape to each other. In these samples, a ratio of the ratio [Al/(Mg+Al)] in terms of the number of atoms (hereinafter simply referred to as "an Al ratio") to the ratio [N/(N+O)] in terms of the number of atoms (hereinafter simply referred to as "an N ratio") is 3 or less. Adjusting the ratio (the Al ratio/the N ratio) to 3 or less, more specifically to 2.4 or less, makes it possible to achieve a particular X-ray electronic emission spectrum with a high peak having the apex in a region of 6 eV or less. Such a protective film has a low discharge starting pressure. Particularly, when both of the Al ratio and the N ratio fall within the range of 2% to 10% as in Samples 2 and 3, a low discharge starting pressure easily can be achieved. In Samples 2 and 3, the ratio (Al ratio/the N ratio) was less than 1.

Figure 5:
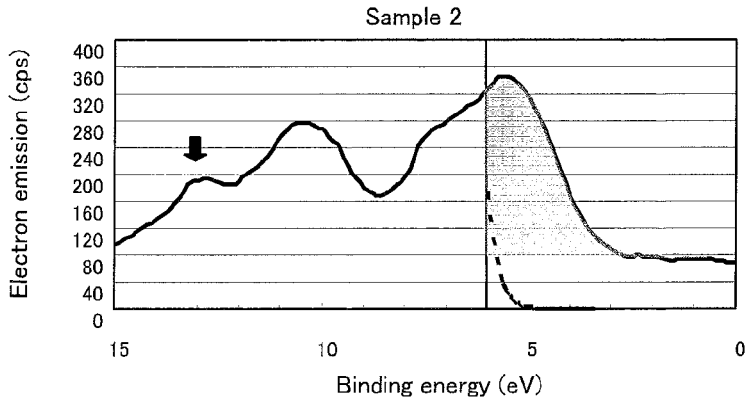
FIG. 5 is a graph showing an X-ray electronic emission spectrum and a UV electronic emission spectrum of Sample 2.
Figure 6:
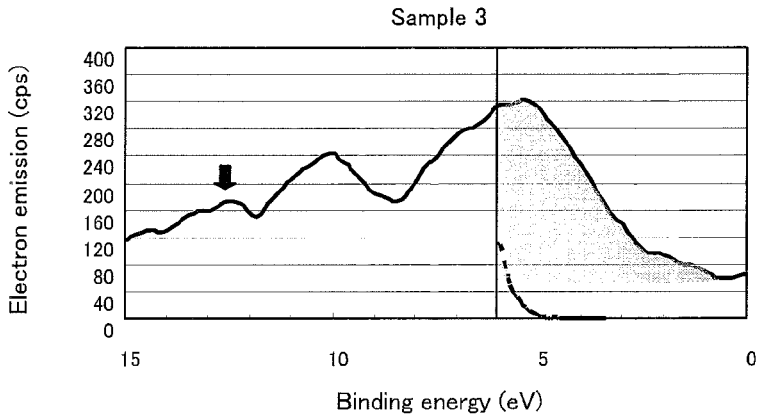
FIG. 6 is a graph showing an X-ray electronic emission spectrum and a UV electronic emission spectrum of Sample 3.
Figure 7:
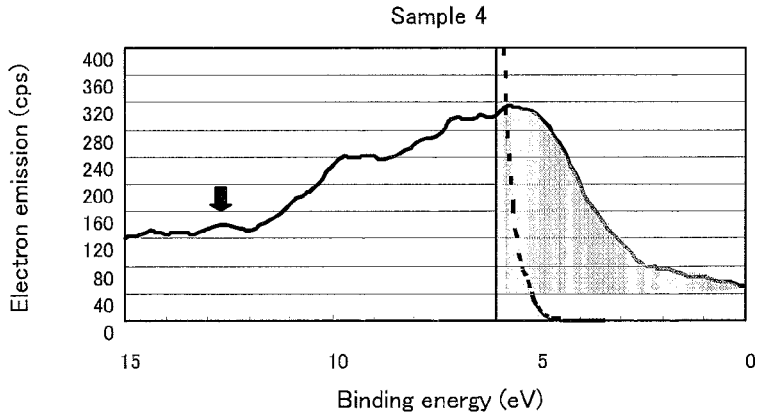
FIG. 7 is a graph showing an X-ray electronic emission spectrum and a UV electronic emission spectrum of Sample 4.
Figure 8:
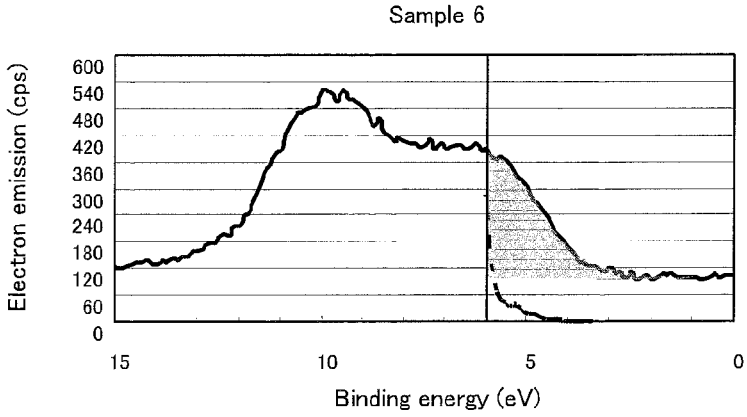
FIG. 8 is a graph showing an X-ray electronic emission spectrum and a UV electronic emission spectrum of Sample 6.
Figure 9:
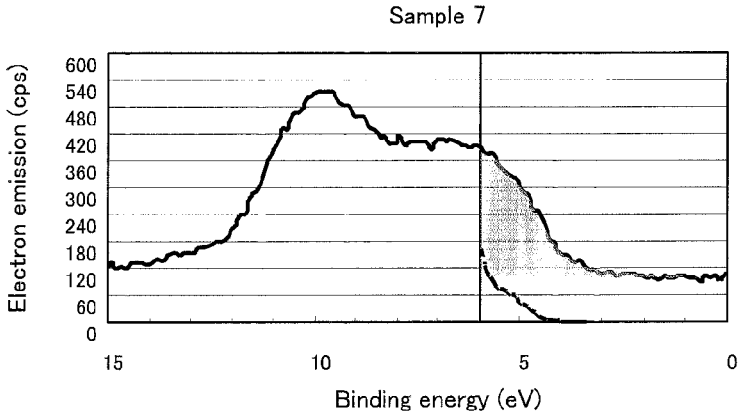
FIG. 9 is a graph showing an X-ray electronic emission spectrum and a UV electronic emission spectrum of Sample 7.

Comparing among FIGS. 5 to 7 (Samples 2 to 4), a peak observed around 12 eV to 13 eV indicated by an arrow is lowered as the Al ratio increases (from FIG. 5 to FIG. 6, and further to FIG. 7). Since this peak corresponds to hydroxylation and carbonation of the surface of the film, the protective film in which this peak is low is advantageous when produced in the mass production of the PDPs. Accordingly, when the chemical change of the surface of the protective film poses a problem, it should be considered to set the Al ratio to 40% or more, more preferably to 42.1%. When the Al ratio is 40% or more, the peak corresponding to hydroxylation and carbonation of the film surface is not observed in the X-ray electronic emission spectrums shown in the other figures, either.

Figure 10:
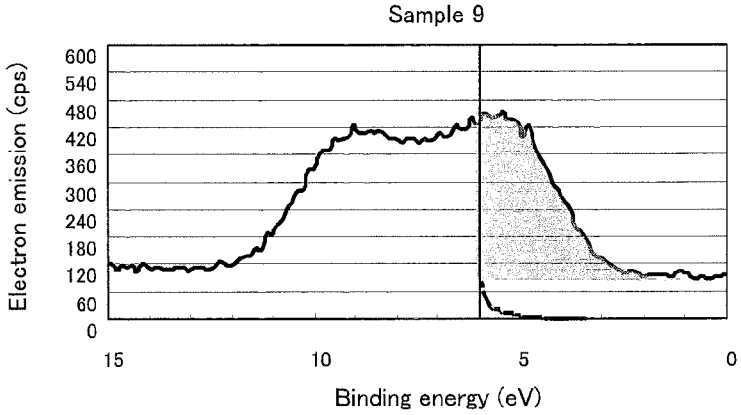
FIG. 10 is a graph showing an X-ray electronic emission spectrum and a UV electronic emission spectrum of Sample 9.

The X-ray electronic emission spectrum shown in FIG. 10 (Sample 9) also has its highest value in the region of 6 eV or less, which corresponds to the fact that Sample 9 had a low discharge starting pressure. The ratio of the N ratio to the Al ratio in Sample 9 was 5.9. Considering this together with the Al ratio and the N ratio of another sample (Sample 10 of FIG. 13) that had a low discharge starting pressure even with the ratio (the Al ratio/the N ratio) exceeding 3, it is found that 40% to 67% for the Al ratio, 5.0% to 18% for the N ratio, and 4 to 6 for the ratio of the N ratio to the Al ratio (the Al ratio/the N ratio) are one preferable composition range for the protective film in order to keep the discharge starting pressure low. It is more preferable that the Al ratio is in the range of 40.2% to 66.5%, the N ratio is in the range of 6.8% to 16.1%, and the ratio of the N ratio to the Al ratio (the Al ratio/the N ratio) is 4.1 to 5.9. This composition range raises the X-ray electronic emission spectrum as a whole. Thereby, a protective film with a low discharge starting pressure can be obtained (see FIG. 13) even when the highest value of the spectrum thereof fails to be 6 eV or less as in Sample 10.

Figure 11:
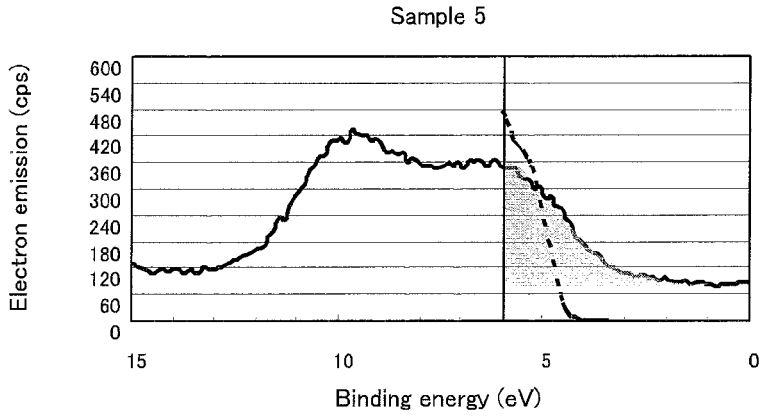
FIG. 11 is a graph showing an X-ray electronic emission spectrum and a UV electronic emission spectrum of Sample 5.

In all of the figures except for FIG. 11 (Sample 5), the energy at the rising of the UV electronic emission spectrum was different from the energy at the rising of the X-ray electronic emission spectrum by approximately 3 eV. It seems that the effect of raising the energy of the valence band by Madelung potential change contributes to this difference because ionic binding relatively is strong in the surface portion of the film. In the protective film (with an Al ratio of 100%) of Sample 5 shown in FIG. 11, it seems that strong covalent binding lowers the density of an electron cloud exiting from the film surface, and thus the discharge starting pressure fails to be lowered.

Figure 12:
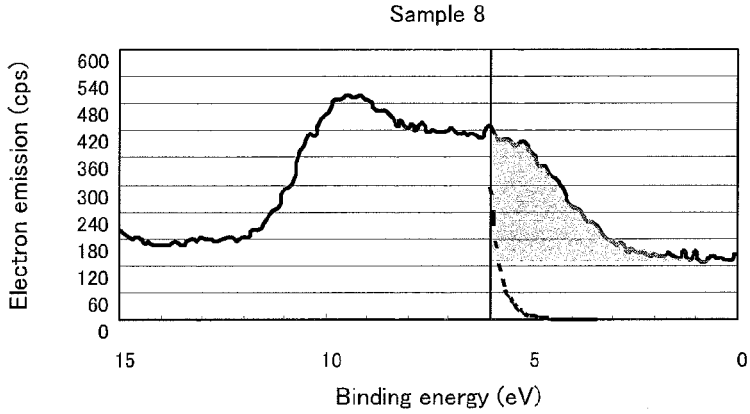
FIG. 12 is a graph showing an X-ray electronic emission spectrum and a UV electronic emission spectrum of Sample 8.
Figure 13:
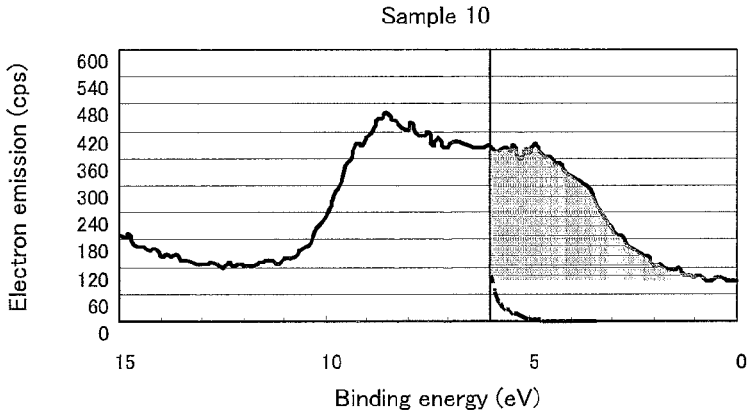
FIG. 13 is a graph showing an X-ray electronic emission spectrum and a UV electronic emission spectrum of Sample 10.

Comparing among FIGS. 11 to 13 (Samples 5, 8, and 10), the effect of raising the valence band increases and the tail part of the X-ray electronic emission spectrum toward the low energy side becomes higher as the Al ratio decreases (from FIG. 11 to FIG. 12, and further to FIG. 13). In contrast, the UV electronic emission spectrum shifts to the high energy side as the Al ratio decreases, and as a result, the difference between the energy at the rising of the UV electronic emission spectrum and the energy at the rising of the X-ray electronic emission spectrum increases. Based on this, it seems that when the Al ratio is approximately as low as that in Sample 10 (67% or less), the discharge starting pressure sufficiently is lowered.

INDUSTRIAL APPLICABILITY

The present invention is useful in obtaining PDPs, particularly PDPs with high luminance and high efficiency.

The invention claimed is:

1. A plasma display panel comprising:

a front substrate;

a rear substrate disposed facing the front substrate; and barrier ribs dividing a space between the front substrate and the rear substrate into discharge spaces, wherein:

a protective film is formed in such a manner that the protective film covers a dielectric layer formed on the front substrate and is in contact with the discharge spaces;

a surface portion of the protective film substantially is composed of magnesium, aluminum, nitrogen, and oxygen;

a ratio of the number of atoms of the aluminum to a total of the number of atoms of the magnesium and the number of atoms of the aluminum is at least 2.1% but not more than 66.5%;

a ratio of the number of atoms of the nitrogen to a total of the number of atoms of the nitrogen and the number of atoms of the oxygen is at least 1.2% but not more than 17.2%; and a ratio of the total of the number of atoms of the nitrogen and the number of atoms of the oxygen to the total of the number of atoms of the magnesium and the number of atoms of the aluminum is at least 1.0 but not more than 1.35.

2. The plasma display panel according to claim 1, wherein a ratio of an Al ratio to an N ratio is 2.4 or less, where the Al ratio is the ratio of the number of atoms of the aluminum to the total of the number of atoms of the magnesium and the number of atoms of the aluminum, and the N ratio is the ratio of the number of atoms of the nitrogen to the total of the number of atoms of the nitrogen and the number of atoms of the oxygen.

3. The plasma display panel according to claim 1, wherein:

an Al ratio that is the ratio of the number of atoms of the aluminum to the total of the number of atoms of the magnesium and the number of atoms of the aluminum is 40.2% to 66.5%;

an N ratio that is the ratio of the number of atoms of the nitrogen to the total of the number of atoms of the nitrogen and the number of atoms of the oxygen is 6.8% to 16.1%; and a ratio of the Al ratio to the N ratio is 4.1 to 5.9.

4. The plasma display panel according to claim 1, wherein:

the discharge spaces are filled with a discharge gas composed of neon and xenon; and a partial pressure of xenon in the discharge gas is 11% to 100% of a total pressure of the discharge gas.

* * * * *